US007329864B2

(12) United States Patent
Wang

(10) Patent No.: US 7,329,864 B2
(45) Date of Patent: Feb. 12, 2008

(54) MASS SPECTROMETRY WITH MULTIPLE IONIZATION SOURCES AND MULTIPLE MASS ANALYZERS

(76) Inventor: Yang Wang, 7 Black Bear La., Westford, MA (US) 01886

( * ) Notice: Subject to any disclaimer, the term of this patent is extended or adjusted under 35 U.S.C. 154(b) by 254 days.

(21) Appl. No.: 11/224,622

(22) Filed: Sep. 12, 2005

(65) Prior Publication Data

US 2007/0057172 A1 Mar. 15, 2007

(51) Int. Cl.
*H01J 49/06* (2006.01)
*H01J 49/42* (2006.01)

(52) U.S. Cl. ..... 250/288; 250/281; 250/292

(58) Field of Classification Search ..... None
See application file for complete search history.

(56) References Cited

U.S. PATENT DOCUMENTS 6,838,666 B2 * 1/2005 Ouyang et al. ..... 250/292

2005/0199804 A1 * 9/2005 Hunt et al. ..... 250/290

OTHER PUBLICATIONS

Wuerker et al., "Electrodynamic Containment of Charged Particles by Three-Phase Voltages", Journal of Applied Physics, vol. 30, 1959, pp. 441-442.*

* cited by examiner

*Primary Examiner*—Jack I. Berman

(57) ABSTRACT

Multiple ionization ion sources and multiple mass analyzers are combined into one mass spectrometer instrument by a six-electrodes ion trap or an array of six-electrodes ion traps. The six-electrodes ion trap can be operated as an independent two-dimensional ion guide or linear ion tap in an arbitrarily selected direction among three orthogonal XYZ directions. The two-dimensional ion guide/linear ion trap can be alternated from one direction to another among the three orthogonal directions electrically. A six-electrodes ion trap generates six equivalent importing and exporting interfaces, each of the interfaces can be used to trap external ions and transfer the trapped ions to any of the other five interfaces. The six-electrodes ion trap provide a mass spectrometer with versatility, multiply functions, high duty-cycles and high sample throughput.

12 Claims, 7 Drawing Sheets

MASS SPECTROMETRY WITH MULTIPLE IONIZATION SOURCES AND MULTIPLE MASS ANALYZERS

FIELD OF THE INVENTION

The invention relates to mass spectrometric analysis of gas-phase chemical and biological species. The invention, in particular, relates to mass spectrometry with multiple ionization sources and multiple mass analyzers combined into one mass spectrometer.

BACKGROUND OF THE INVENTION

Mass spectrometry is a method of analyzing gas-phase ions generated from a particle molecular sample. The gas-phase ions are separated in electric and/or magnetic fields according to their mass-to-charge ratio. Analyzing molecular weights of samples using mass spectrometry consists mainly of three processes: generating gas phase ions, separating and analyzing the ions according to their mass-to-charge ratio and detecting the ions. The mass spectrometer is an instrument for implementing processes to measure the gas-phase mass ions or molecular ions in a vacuum chamber via ionizing the gas molecules and to measure the mass-to-charge ratio of the ions.

Formation of gas phase samples ions is an essential in a mass spectrometer. There are many ionization methods and related sources suitable for different kinds of samples. Ions may be generated by electron ionization (EI) in vacuum. EI is the most appropriate technique for relatively small ($m/z<700$) neutral organic molecules that can easily be promoted to the gas phase by heating without decomposition, (i.e. volatilization). Electron ionization is achieved through the interaction of an analyte with an energetic electron beam resulting in the loss of an electron from the analyte and the production of a radical cation. Electrons are produced by thermionic emission from a tungsten or rhenium filament. These electrons leave the filament surface and are accelerated towards the ion source chamber, which is held at a positive potential (equal to the accelerating voltage). The electrons acquire energy equal to the voltage between the filament and the source chamber, which typically is about 70 electron volts (70 eV).

In contrast to EI, most applications of chemical ionization (CI) produce ions by the relatively gentle process of proton transfer. The sample molecules are exposed to a large excess of ionized reagent gas. Transfer of a proton to a sample molecule M, from an ionized reagent gas such as methane in the form of $CH_5^+$, yields the $[M+H]^+$ positive ion. Negative ions can also be produced under chemical ionization conditions. Transfer of a proton from M to other types of reagent gas or ions can leave $[M-H]^-$, a negatively charged sample ion.

Corona discharge ionization is an electrical discharge characterized by a corona. Corona discharge ionization occurs when one of two electrodes placed in a gas (i.e. a discharge electrode) has a shape causing the electric field on its surface to be significantly greater than that between the electrodes. Corona discharges are usually created in gas held at or near atmospheric pressure. Corona discharge may be positive or negative according to the polarity of the voltage applied to the higher curvature electrode i.e. the discharge electrode. If the discharge electrode is positive with respect to the flat electrode, the discharge is a positive corona, if negative the discharge is a negative corona.

Desorption ionization is a term used to describe the process by which a molecule is both evaporated from a surface and ionized. Samples are desorbed and ionized by an impact process that involves bombardment of the sample with high velocity atoms, ions, fission fragments, or photons of relatively high energy. The impact deposits energy into the sample, either directly or via the matrix, and leads to both sample molecule transfer into the gas phase and ionization. Fast atom bombardment (FAB) involves impact of high velocity atoms on a sample dissolved in a liquid matrix. Secondary ion mass spectrometry (SIMS) involves impact of high velocity ions on a thin film of sample on a metal substrate or dissolved in a liquid matrix. Plasma desorption (PD) involves impact of nuclear fission fragments, e.g. from $^{252}Cf$, on a solid sample deposited on a metal foil. Matrix assisted laser desorption ionization (MALDI) involves impact of high energy photons on a sample embedded in a solid organic matrix.

In field desorption (FD), the sample is coated as a thin film onto a special filament placed within a very high intensity electric field. In this environment, ions created by field-induced removal of an electron from the molecule are extracted into the mass spectrometer.

Atmospheric pressure ionization (API) can generate sample ions from liquid solution in atmospheric pressure. Electrospray ionization (ESI) is a widely used method to produce gaseous ionized molecules desolvated or desorbed from a liquid solution by creating a fine spray of droplets in the presence of a strong electric field. The ESI source consists of a very fine needle and a series of skimmers. A sample solution is sprayed into the source chamber to form droplets. The droplets carry charge when the exit the capillary and as the solvent vaporizes the droplets disappear leaving highly charged analyte molecules. Electrospray ionization is the method of choice for proteins, oligonucleotides and metal complexes. However, the sample must be soluble in low boiling solvents (acetonitrile, MeOH, $CH_3Cl$, water, etc.). Atmospheric pressure chemical ionization (APCI) is a relative of ESI. The ion source is similar to the ESI ion source. In addition to the electro hydrodynamic spraying process, a plasma is created by a corona-discharge needle at the end of the metal capillary. In this plasma, proton transfer reactions and possibly a small amount fragmentation can occur. Depending on the solvents, only quasi-molecular ions like $[M+H]^+$, $[M+Na]^+$ and $M^+$ (in the case of aromatics), and/or fragments can be produced. Multiply charged molecules, as in ESI, are not observed. Atmospheric pressure photoionization (APPI) is a complement to ESI and APCI by expanding the range and classes of compounds that can be analyzed, including nonpolar molecules that are not easily ionized by ESI or APCI. The mechanism of photoionization—ejection of an electron following photon absorption by a molecule—is independent of the surrounding molecules, thereby reducing ion suppression effects.

In addition, plasma and glow discharge, thermal ionization and spark ionization are also used in mass spectrometry.

In conclusion, different phases and different kinds of molecular samples are ionized by different ionization methods. The same phase and same kind of molecular samples can be ionized by different ionization methods.

Mass analysis can also be performed using methods based on specific electric and/or magnetic field distributions or configurations. Several such configurations are described below:

A magnetic sector analyzer analyzes ion mass using a static magnetic field to disperse ions according to ion mass.

A quadrupole mass filter or quadrupole ion trap (QIT) or quadrupole linear ion trap (LIT) analyzer uses the stability or instability of ion trajectories in a dynamical electric RF field to separate ions according to their different m/z ratios. The quadrupole filter consists of four parallel metal rods. Both radio frequency (RF) voltages and direct current (DC) voltages with opposite polarities are applied across two pair of rods. Ions travel down the quadrupole in between the rods. Only ions of a certain m/z will reach the detector for a given ratio of RF and DC voltages: other ions have unstable oscillations and will collide with the rods. A quadrupole ion trap (QIT) mass analyzer is composed of a metal ring electrode and a pair of opposite metal end cap electrodes. The inner surfaces of the ring and two end cap electrodes are rotationally symmetric hyperboloids. Mass ion is trapped and then analyzed by so-called mass scanning methods. There are three different mass scanning methods to analyze the ion mass in commercial ion trap mass spectrometers: mass-selective instability scan, mass-selective scan by non-linear resonance, and mass-selective resonance scan by excitation frequency. The mass selective instability scan uses the stability boundary of the first stability region in Mathieu's stability diagram. During the mass scan, RF voltage applied the ring electrode is increased linearly. The working points of the mass ions are shifted across the stability border. The ions become unstable, oscillate in axial direction, and finally leave the ion trap through one of the end caps, one mass followed by another mass. The mass selective scan by nonlinear resonance uses the sharp amplitude growth in the ion oscillation due to nonlinear resonance conditions which arise in the ion trap caused by superposition of the quadrupole field with higher-order multipole fields. Such a nonlinear resonance condition occurs within the stability diagram. This method leads to particularly quick scanning to improve mass resolution. The mass-selective resonance scan is performed by applying an additional excitation frequency voltage between two cap electrodes. The ions are ejected from the ion trap by resonant dipolar excitation in the axial direction. The ions absorb energy from the dipole field and increase their oscillation amplitude at resonance. Ions leave the ion trap one mass followed by another mass, if the dipole field is sufficiently strong.

A Fourier Transformation Ion Cyclotron Resonance (FT-ICR) mass analyzer is based on the principle of ion cyclotron resonance. An ion placed in a magnetic field will move in a circular orbit at a frequency characteristic of its m/z value. Ions are excited to a coherent orbit using a pulse of radio frequency energy, and their image charge is detected on receiver plates as a time domain signal. Fourier transformation of the time domain signal results in the frequency domain FT-ICR signal which, on the basis of the inverse proportionality between frequency and m/z, can be converted to a mass spectrum.

A Time-of-flight (TOF) mass analyzer separates ions by m/z in a field-free region after accelerating ions to a constant kinetic energy. This acceleration results in any given ion having the same kinetic energy as any other ion. The velocity of the ion will however depend on the mass. The time that it subsequently takes for the particle to reach a detector at a known distance is measured. This time will depend on the mass of the particle (heavier particles reach lower speeds). From this time and the known experimental parameters one can find the mass of the particle.

The different mass analyzers have different features and advantages. For example, an ion trap analyzer has high sensitivity but medium mass resolving power, while TOF has a high mass accuracy and fast scan speed. ICR has ultra high mass resolving power and mass accuracy but is very expensive, which limits its wide application.

Tandem mass spectrometry, which is widely applied, involves at least two steps of mass selection or analysis, usually with some form of fragmentation in between. Coupling two stages of mass analysis (MS/MS) can be very useful in identifying compounds in complex mixtures and in determining structures of unknown substances. In product ion scanning, the most frequently used MS/MS mode, product ion spectra of ions of any chosen m/z value represented in the conventional mass spectrum are generated. From a mixture of ions in the source region or collected in an ion trap, ions of a particular m/z value are selected in the first stage of mass analysis. These "parent" or "precursor" ions are fragmented and then the product ions resulting from the fragmentation are analyzed in a second stage of mass analysis. If the sample is a mixture and soft ionization is used to produce, for example, predominantly $[M+H]^+$ ions, then the second stage of MS can be used to obtain an identifying mass spectrum for each component in the mixture. For sector, quadrupole and time-of-flight instruments, each stage of mass analysis requires a separate mass analyzer.

A triple quadrupole mass spectrometer uses three quadrupole/multipole devices. The first quadrupole mass analyzer is used for parent ion selection, the second multipole collision cell is used for fragmentation and the third quadrupole is used for analyzing the fragmentation (daughter) ions. The quadrupole/TOF hybrid mass spectrometer, or Q-TOF, replaces the third quadrupole in triple quadrupole with TOF analyzer to give higher resolution and better mass accuracy. For quadrupole ion trap or ICR mass spectrometers, the MS/MS experiment can be conducted sequentially in time within a single mass analyzer. Ions can be selectively isolated, excited and fragmented, and analyzed sequentially in the same device. In addition, hybrid mass spectrometers may include a quadrupole linear ion trap combined with quadrupole ion trap (q-QIT), a quadrupole linear ion trap with FT-ICR, or an quadrupole ion trap with time-of-flight (QIT-TOF).

Several methods of fragmenting molecules for tandem mass spectrometry exist including collision-induced dissociation (CID), electron capture dissociation (ECD), Infrared multiphoton dissociation (IRMPD) and blackbody infrared radiative dissociation (BIRD). Collision-induced dissociation (CID), which is referred to by some as collisionally activated dissociation (CAD), is a mechanism by which molecular ions are fragemented in the gas phase. The molecular ions are usually accelerated by some electrical potential to high kinetic energy and then allowed to collide with neutral gas molecules (often helium, hydrogen or argon). In the collision, some of the kinetic energy is converted into internal energy, which results in bond breakage and the fragmentation of the molecular ion into smaller fragments. Electron capture dissociation (ECD) involves the introduction of low energy electrons to trapped gas phase ions. In infrared multiphoton dissociation (IRMPD), an infrared laser is directed through a window into the vacuum chamber of the mass spectrometer containing the ions. The mechanism of fragmentation involves the absorption by a given ion of multiple infrared photons. The parent ion becomes excited into more energetic vibrational states until a bond(s) is broken resulting in gas phase fragments of the parent ion. Blackbody infrared radiative dissociation (BIRD) uses the light from black body radiation to thermally (vibrationally) excite the ions until a bond breaks. This is very similar to infrared multiphoton dissociation with the exception of the source of radiation.

In a mass spectrometer, once ions generated by an ionization source, they must be transported by an interface device to the mass analyzer through a transfer region. This interface device may be an ion optical system such as a Radio frequency (RF) linear multipole ion guide. A RF linear multipole (quadrupole, hexapole, octopole, and so on) ion guide consists of four parallel metal rods (quadrupole) or six rods (hexapole) or eight rods (octopole) and is supplied with RF voltages with a typical RF frequency at 1-5 MHz. The ion guide is often used in coupling an elevated pressure ionization source, most an API source, such as ESI, to a mass analyzer operated in a vacuum of about $10^{-4}$ torr or higher. The use of linear multipole ion guides has been shown to be an effective means of transporting ions through vacuum. U.S. Pat. No. 4,963,736 (1990) described the use of an RF-only quadrupole ion guide to transport ions from an API source to a mass analyzer. U.S. Pat. No. 5,652,427 (1997) describes the use RF linear multiple ion guides to transfer ions from one pressure region to another in a differentially pumped system.

A linear multipole ion guide is easily converted into a linear ion trap by applying a static DC potential to electrodes at the entrance and the exit of the multipole ion guide device. Ions are then confined radially by a two-dimensional (2D) RF field, and axially by static DC potentials. In contrast to a three-dimensional (3D) ion trap, ions are not confined axially by RF potentials in a linear ion trap. A linear ion trap has a high acceptance since there is no RF quadrupole field along the z-axis. Ions admitted into a pressurized linear quadrupole undergo a series of momentum dissipating collisions effectively reducing axial energy prior to encountering the end of electrodes, thereby enhancing trapping efficiency. A larger volume of the pressurized linear ion trap relative to the 3D device also means that more ions can be trapped. Radial containment of ions within a linear ion trap focuses ions to a line, while the 3D ion trap tends to focus the trapped ions to a point. It has been recognized that ions can be trapped in a linear ion trap and mass selectively ejected in a direction perpendicular to the central axis of the trap via radial excitation techniques, or mass selective axially ejected in the presence of an auxiliary quadrupole field.

The linear ion trap has axially combined in serial with a 3D ion trap, a time-of-flight (TOF) or FT-ICR mass analyzer. Combining a linear ion trap with a 3D trap can help to overcome the limitation of poor duty-cycle (transmission efficiency) and space charge effects. Coupling a linear multipole trap to a 3D ion trap was been described in U.S. Pat. No 5,179,278. To improve the duty-cycle, ions are accumulated in the linear ion trap, whereas the 3D trap performs other functions such as CID or mass analysis.

Usually, the linear multipole ion guide or linear ion trap combines a single ion source to a single mass analyzer because it has two interfaces, entrance and exit, in the z-axis only. The present invention discloses a six-electrodes ion trap device and operating method, which can generate six "z-axis" interfaces in three-dimensional XYZ space and can be alternated from an axis to another. Ions can be injected in different directions and transferred to different directions for specific purposes. The design allows combination of multiple ion sources and mass analyzers into a single instrument.

Langmuir et al. first reported a six-electrodes ion trap in the early 60s. The ion trap was constructed with a specific six plane sheets of metal and mounted parallel to the faces of a cube. (See e.g., R. F. Wuerker, H. M. Goldenberg and R. V. Langmuir, J. *Appl. Phys.,* 30, 44, 1959). In a later model by Haught and Polk, this sheet structure was replaced by a set of six annuli. (See e.g., A. F. Haught and D. H. Polk, *Phys. Fluids,* 9, 2049, 1966). These early six-electrode ion traps with simple surfaces generated very poor quadrupole field and have low trapping efficiency. All previous works of six-electrodes ion traps with the specific surface shapes were involved with ion storage or mass analyzing. Until the present invention, a six-electrode ion trap has not been used as a device to combine multiple ion sources and mass analyzers into a single instrument.

SUMMARY OF THE INVENTION

A six-electrodes ion trap (or traps) combines multiple ionization sources and multiple mass analyzers into one mass spectrometer instrument. The six-electrodes ion trap can be operated as an independent two-dimensional ion guide or linear ion tap in an arbitrarily selected direction amongst the three orthogonal XYZ directions. The inventive two-dimensional ion guide/linear ion trap can be alternated from one direction to another among the three orthogonal directions electrically. A six-electrodes ion trap generates three ion guides/linear ion traps with six equivalent importing and exporting interfaces, each of the interfaces can be used to trap external ions and transfer the trapped ions to any of the other five interfaces. The six-electrodes ion trap supplies mass spectrometers with versatility, multiple functions, high duty-cycles and high sample throughput.

In another aspect of the invention, the six-electrodes ion trap can be operated as a collision cell to perform CID process for ions.

In another aspect of the invention, the six-electrodes ion trap can be operated as ion mass selector to select a range of ion mass.

Embodiments of the invention include, for example, a six-electrode ion trap combining ESI source and CI source with ion trap mass analyzer or/and TOF mass analyzer.

Other features, aspects, and advantages of the invention will become apparent from the description, the drawings, and the claims.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 2:
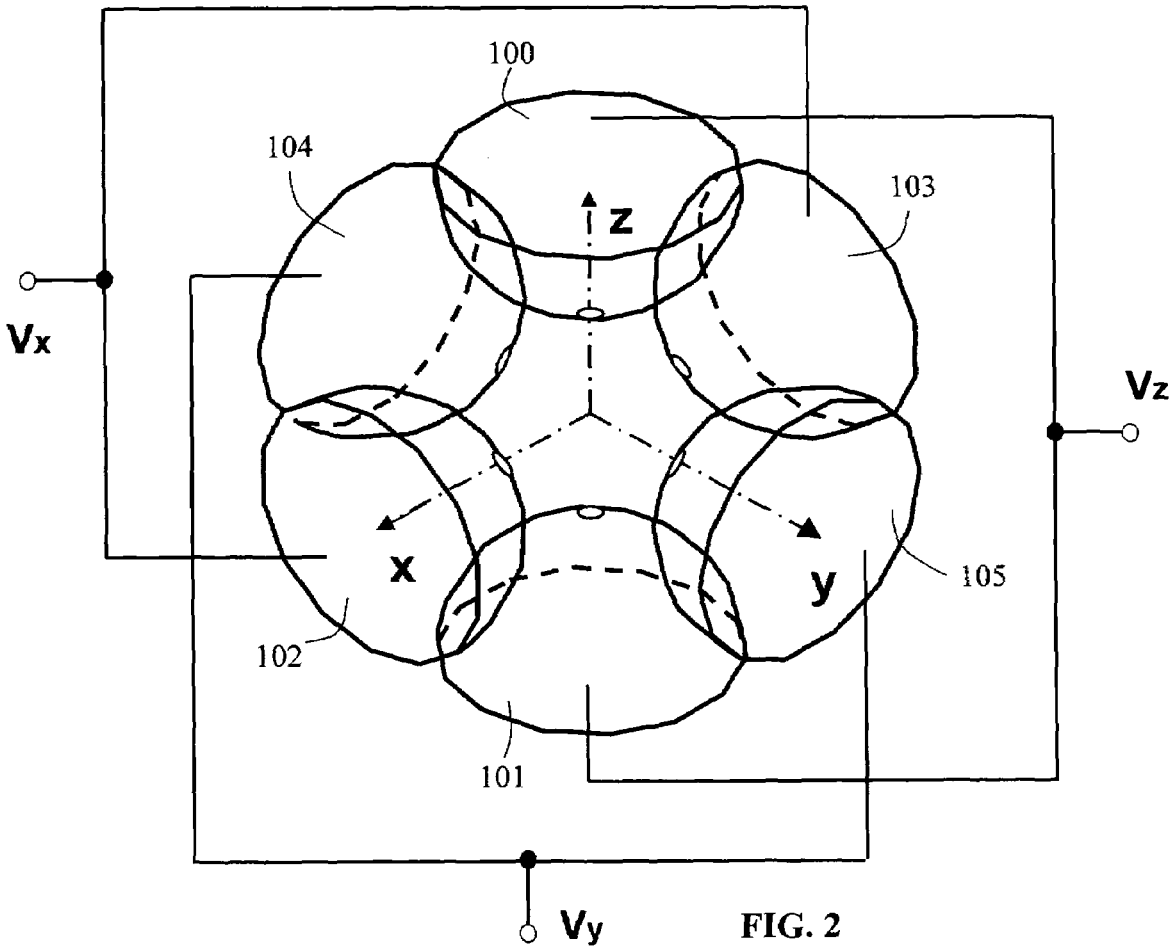
FIG. 2 illustrates a six-electrodes ion trap. The six-electrodes ion trap consists of six identical metal electrodes with orientations in six different directions in the space, in accordance with the principles of the present invention. The surface of each electrode is constructed with identical curved shape. Six electrodes are arranged in identical distance from each other. The voltages are applied to the electrodes.

A six-electrodes ion trap is provided. The six-electrodes ion trap consists of six identical metal electrodes orientated in six different directions in the space. Each electrode has a small hole or a few small holes in the center of the electrode for ion import or export. These six electrodes may have three plane symmetries and may be arranged at identical distances from each other. FIG. 2 shows the six-electrode ion trap in a three-dimensional space coordinates. Each of the six electrodes has an identical curved surface, for example, a spherical surface with a half diameter $R_0$ or a hyperbolic surface. These electrodes are located in x-, y-, and z-axis, respectively, with the same distance $r_0$ from the center point of coordinates.

An exemplary six-electrode ion trap has six curved electrode surfaces facing the inside of the device, with a hole or a few holes in the center. The inside volume of the device is cubic. The electrodes are located in three orthogonal directions of space with identical distance from each other; with pairs of opposite electrodes connected together. RF and DC voltages can be applied to each pair. Each electrode can be interfaced to an ionization source or mass analyzer.

For convenient explanation, the pair of electrodes located on the x-axis is called the pair x, on the y-axis is called the pair y, and on is called the z-axis is called the pair z. Each pair consists of two opposite located electrodes. The device is operated in a vacuum chamber at a vacuum, which may be higher than $10^{-1}$ torr.

In Cartesian coordinates, a 3D electric potential $\Phi(x, y, z)$ can be generally expanded in serial multipoles, $\Phi_n(x, y, z)$, as $$\Phi(x, y, z)=\Sigma A_n{}^*\phi_n(x, y, z), \tag{1}$$

where $A_n$ is the amplitude of the multipole $\phi_n(x, y, z)$ and n is equal to integers (0, 1, 2, . . . ). The term $\phi_0(x, y, z)=1$ represents a potential that is constant (independent of x and y and z); $\phi_1$ (x, y, z) represents the dipole potential; $\phi_2$ (x, y, z) is a quadrupole potential; $\phi_3$ (x, y, z) is a hexapole potential; $\phi_4$ (x, y, z) is a octopole potential; etc. If the pair-x is applied voltage Vx; the pair-y voltage Vy; and the pair-z voltage Vz, the potential distribution in the trap can be expressed, due to the planar symmetry in xyz coordinates, as $$\Phi(x, y, z) = [2*V_x/(3*r_0^2)]*[x^2-(y^2+z^2)/2]+[2*V_y/(3*r_0^2)]*[y^2-(x^2+z^2)/2]+[2*V_z/(3*r_0^2)]*[z^2-(x^2+y^2)/2]+\Sigma A_n\cdot\phi_n(x, y, z) \tag{2}$$

where n is an even integer and is larger than 2 (n=4, 6, 8, . . . ). Each term of the first three terms represents a three-dimensional quadrupole potential and the last term represents the sum of higher even multipoles.

In case I, if we set $$Vx=Vy=0,\ Vz=V^*\mathrm{Cos}(2\pi f^*t) \tag{3}$$

or set $$Vx=Vy=-V^*\mathrm{Cos}(2\pi f^*t),\ Vz=0 \tag{4}$$

where V is the amplitude of RF voltage and f is the RF frequency of typical value at 1-5 Mhz, then equation (2) becomes $$\Phi(x,y,z)=[2/(3^*r_0^2)]^*V^*\mathrm{Cos}(2\pi f^*t)^*[z^2-(x^2+y^2)/2]+\Sigma A_n{}^*\phi_n(x,y,z) \tag{5}$$

In this case, the six-electrodes ion trap operates as a main three-dimensional RF ion trap in symmetrical z-axis. In same way, we can generate three-dimensional RF ion trap in symmetrical x-axis or y-axis. It is well known that ions can be trapped in a three-dimensional RF ion trap.

In case II, if we set:

$$Vz=U \text{ and } Vx=-Vy=V^*\mathrm{Cos}(2\pi f^*t) \tag{6}$$

where U is the DC voltage, the equation (2) becomes $$\Phi(x,y,z)=V^*\mathrm{Cos}(2\pi f^*t)^*(x^2-y^2)/r_0^2+[2^*U/(3^*r_0^2)]^*[z^2-(x^2+y^2)/2]+\Sigma(\text{higher even multiples}) \tag{7}$$

In this case, the six-electrodes ion trap operates as a main linear ion trap. In the special case that U is zero, equation 7 has no the second term of DC quadrupole field. The six-electrodes ion trap operates as a quadrupole ion guide because the first term is a two-dimensional RF quadrupole field.

Alternatively, in case III, if we set:

$$Vz=0;\ Vx=-U+V\,\mathrm{Cos}(2\pi f^*t) \text{ and } Vy=-U-V\,\mathrm{Cos}(2\pi f^*t), \tag{8}$$

Equation (2) becomes $$\Phi(x, y, z)=V^*\mathrm{Cos}(2\pi f^*t)^*(x^2-y^2)/r_0^2+[2^*U/(3^*r_0^2)]^*[z^2-(x^2+y^2)/2]+\Sigma(\text{higher even multiples}) \tag{9}$$

We get the same result as equation 7. According to principles of electrostatic fields, it is understandable that applying zero voltage to a pair electrodes and –U voltage to other two pair electrodes is equal to applying U voltage to the first pair and zero voltage to other two pair. In practice, we can obtain the same result or effect by using two alternatives of applying DC voltage. Cases II and III are such cases. For brevity, only Case II is discussed further herein with the understanding that case III is similar.

If the six-electrodes ion trap is operated as a linear ion guide, voltage U is set zero in Equation 7, then there is no DC quadrupole filed: the six-electrodes ion trap transfer ions from the entrance to exit of the device in z-axis. To transfer or transport ions from one direction to another direction, there are three steps: trapping ions, alternating direction of linear ion trap and exiting ions in this direction. Each of these steps is described below, one after the other.

Ions can be trapped in the fields described in equation 7. The first term of the equation 7 represents a two-dimensional RF quadrupole potential in the xy-plane. The second term represents a three-dimensional DC quadrupole potential in symmetric z-axis. The last term is summarizes higher even multiples (n is equal and larger than four, 4, 6, 8 and so on). Therefore, a multiple field with a main two-dimensional RF quadrupole in xy-plane and a main three-dimensional DC quadrupole in z-axis are generated in the six-electrodes ion trap. The motion of an ion in a two-dimensional RF quadrupole field can be stable (trapped) or unstable (lost on electrodes) depending on the structure and electric parameters. (See e.g., P. H. Dowson. Quadrupole Mass Spectrometry and its Applications. Elsevier, Amsterdam, 1976.). Also, an ion can be confined in an electrostatic quadrupole field with the same polarity as the ion. The confined ion will oscillate in sine or cosine trajectory in the DC quadrupole field if the potential energy eU is larger than the kinetic energy of the ion. Upon collision with neutral gas, the ion will lose its kinetic energy to reach a thermal energy equal to that of gas to be trapped in the field. This process is called collision cooling of ions. In the application, ions can be injected from the entrance electrode at z-axis into the six-electrodes ion trap. The voltage U is about a few volt to trap ions in z-axis, and the voltage V is a few hundred RF voltage to trap ions in xy-plane. Although there are diverging electrostatic forces in xy-plane they are smaller than RF field, so that the ion is overall trapped in the xy-plane. This can be easily understood using the stability diagram of the RF quadrupole fields because ion motion parameters are located in the stability diagram with both DC and RF quadrupole fields. After ion trapping, by gating DC voltage U to zero in exit electrode at z-axis, the trapped ions can be drawn out from exit electrode, so that ions can be transferred to mass analyzer in z-axis direction. Similarly, because of the structural symmetry in xyz planes, an RF quadrupole in the xz-plane and a DC quadrupole in symmetric y-axis, or an RF quadrupole in the yz-plane and DC quadrupole in symmetric x-axis can be generated.

The above describes the general method for generating multipole linear ion trap or ion guide fields in a six-electrodes ion trap having arbitrary electrode surface shapes. In practice, the electrode surface may be constructed with a spherical or hyperboloid or other shape forms. By adjusting the structure parameters, for example, the half diameter $R_0$ of spherical surface, the higher even multiples can be minimized. Therefore, the quadrupole fields will be more dominant, which makes the ion trap more efficient in trapping ions.

To alternate the linear ion trap from one direction to another direction, the voltage V and U are alternated electrically from one pair of electrodes to other pairs of electrodes regularly.

Figure 3:
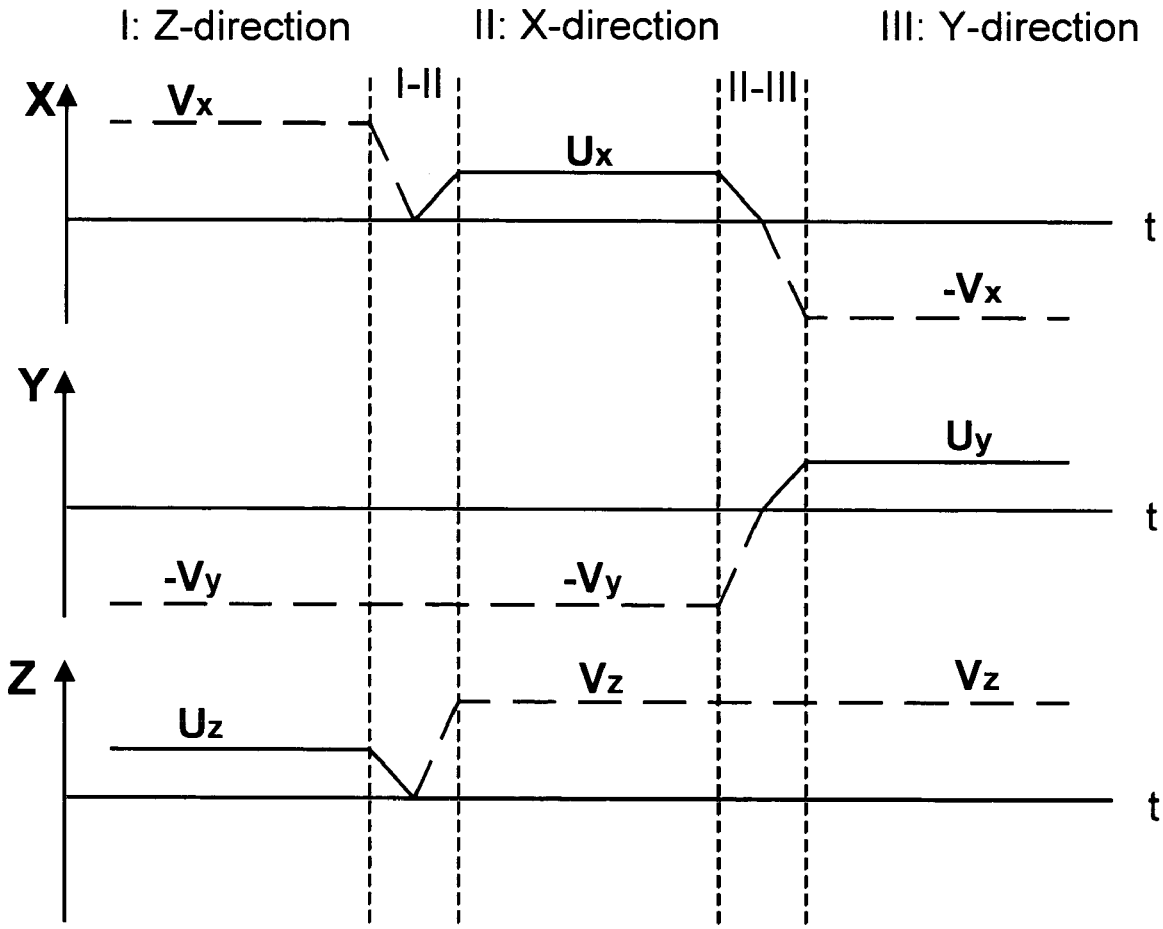
FIG. 3 illustrates a voltage variation diagram of a six-electrodes ion trap, in accordance with the principles of the present invention. The applied RF and DC voltages are shown for six-electrode ion trap, which is operated in three different directions, i.e. z-axis, x-axis and y-axis. The diagram also shows voltage alternations for alternating ion guide direction.

FIG. 3 shows a graph of voltage variations with time in the six-electrodes ion trap. The graph shows the applied RF and DC voltages when the six-electrode ion trap is operated in three different directions, i.e. z-axis, x-axis and y-axis. The graph also shows the voltage variations during alternating linear ion trap direction. In section I, the direction of the linear ion trap is in z-axis; while in section II, the direction of the linear trap is in x-axis; and in section III, the direction of the linear trap is in y-axis. During alternating direction between sections I and II, the six-electrodes ion trap is operated in a three-dimensional ion trap mode to trap ions according to case I above. This alternating process can proceed quickly by ramping the DC and RF voltages or by directly switching from section I to section II electrically. After the direction changing, the ions can be gated out of the ion trap in the corresponding direction by gating DC voltage U to a lower voltage (zero or negative voltage for positive ions).

The six-electrodes ion trap can be operated as an independent two-dimensional ion guide or linear ion tap (linear trap) in an arbitrarily selected direction among three orthogonal XYZ directions. The two-dimensional ion guide/linear ion trap can be electrically alternated from one direction to another among the three orthogonal directions. Therefore, six-electrodes ion trap generates three ion guides/linear ion traps with six equivalent importing and exporting interfaces. Each of the interfaces can be used to trap external ions and transfer the trapped ions to any of the other five interfaces shown in FIG. 1. The trap has the functionality of three directionally interchangeable linear multipole ion guides/ion traps in orthogonal directions. The function of the six-electrodes ion trap is similar to that of an optical prism, which directs a light beam in one direction to another direction. The six-electrodes ion trap can generate a linear ion trap in any axial direction of the three-dimensional space. Electrically alternating or switching RF voltages and DC voltages can alternate the direction of linear ion trap from one to another.

Figure 1:
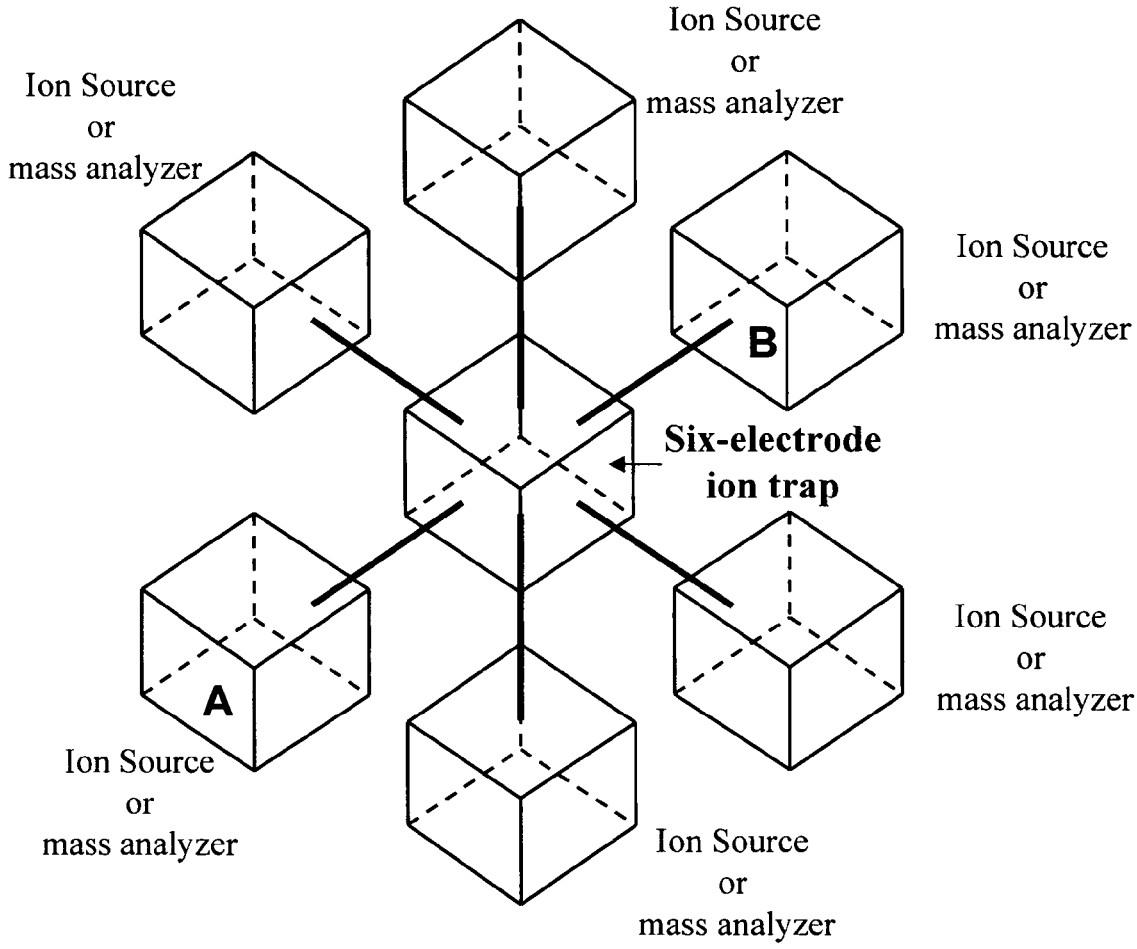
FIG. 1 illustrates the concept of a six-electrodes ion trap that combines multiple ionization sources and multiple mass analyzers into one mass spectrometer. The six-electrodes ion trap generates three ion guides/linear ion traps with six equivalent importing and exporting interfaces, each of the interfaces can be used to trap external ions and transfer the trapped ions to any of the other five interfaces, in accordance with the principles of the present invention.

The disclosed six-electrodes ion trap will provided a mass spectrometer with versatility, multiple functions, high duty-cycles and high sample throughput. As shown in FIG. 1 conceptually up to five ionization sources can be coupled to a mass spectrometer instrument having one mass-ion analyzer. The mass spectrometer consists of an ion source array. Such configuration will improve measurement efficiency and provide high sample throughput because one will no longer need to change an ion source or instrument with different ion sources. The disclosed six-electrodes ion trap will improve the validity of the spectra for different ion sources because the spectra are obtained from an identical analyzer and detection system including electronics. The disclosed six-electrodes ion trap will allow comparisons of spectra and results generated with different ion sources. Also, it will combine the advanced features of the different ion sources for analyzing the different samples. Additionally, using the six-electrodes ion trap can combine different mass analyzers to use their specific advanced features. For example, coupling the TOF analyzer and ion trap analyzer to the six-electrodes ion trap makes it possible to perform experiments with flexibility. It will be possible, for example, to perform a single ion-mass selection and $MS^n$ experiment in ion trap to utilize the high sensitivity, easily perform fragmentation of ion trap, and then perform ion-mass analysis in TOF if high mass accuracy is needed. In the same way, the triply-quadrupole analyzer also can be combined to the instrument if one needs the quantitative analysis of samples.

Figure 4:
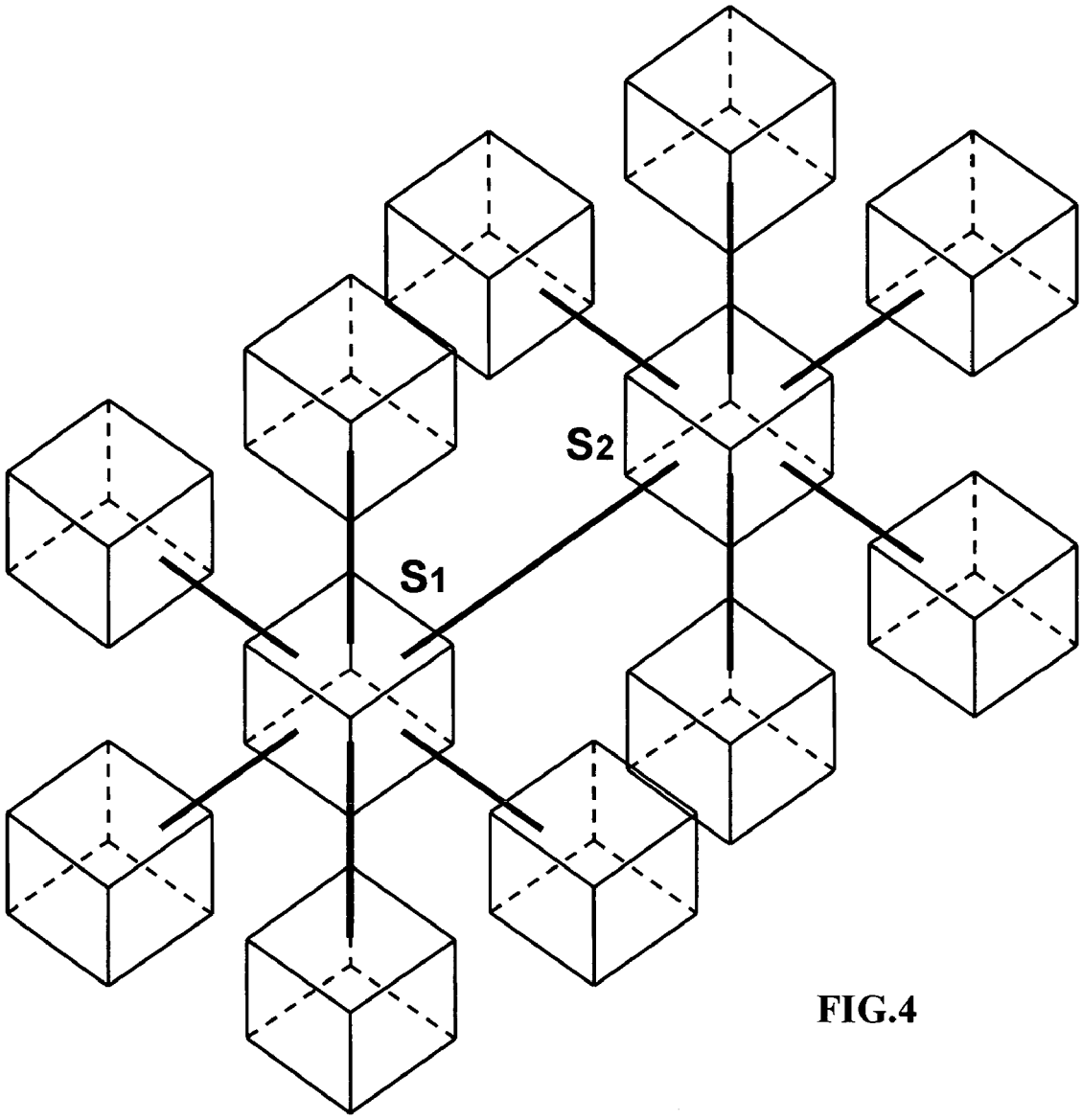
FIG. 4 illustrates a concept of a tandem six-electrodes ion trap. Two six-electrodes ion traps are connected together in serial to couple more than five ion sources or five mass analyzers, in accordance with the principles of the present invention. Two or more, or an array of six-electrodes ion traps can be constructed in the same way.

Furthermore, by using two six-electrodes ion traps in serial, more ion sources and analyzers could be combined into a mass spectrometer, as shown in FIG. 4. In this way, an ion source array and mass analyzer array could be constructed with an array of six-electrodes ion traps.

In addition to ion guide/linear ion trap, the six-electrode ion trap can also work as a fragmentation device for collision-induced dissociation (CID) if it is operated as a trapping device like a collision cell. Furthermore, in an analog to the QIT, the six-electrodes ion trap can work as a mass-range selection device to improve the dynamic range of a mass spectrometer. In this case, the six-electrodes ion trap is operated as a three dimensional ion trap as described by Equation 5.

Figure 5:
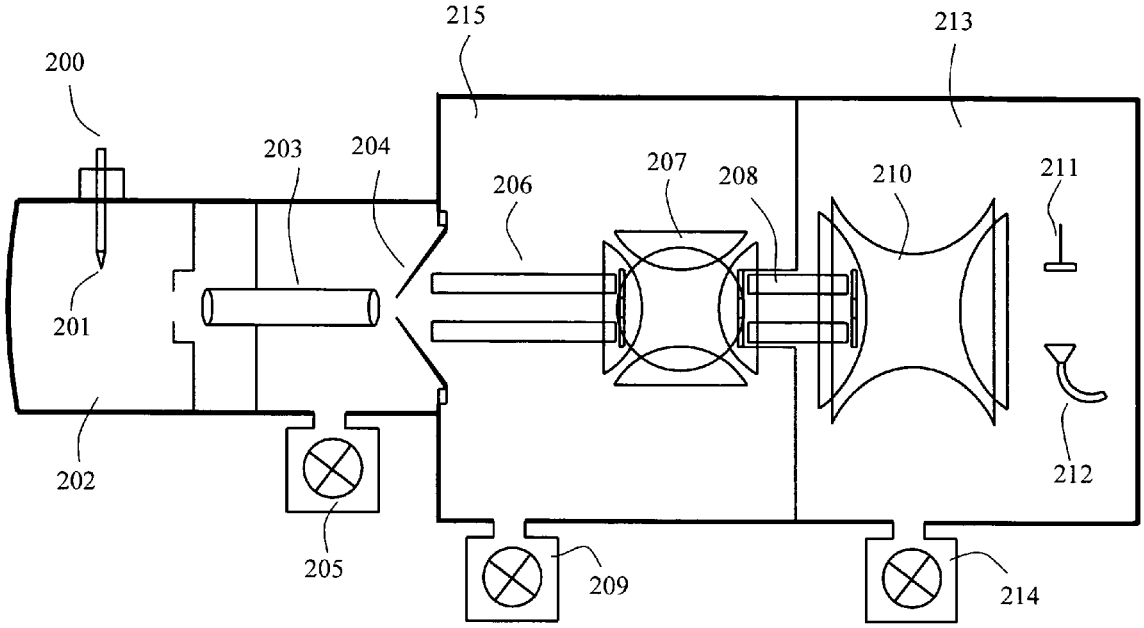
FIG. 5 illustrates a hybrid mass spectrometer with six-electrodes ion trap combining ESI source and ion trap mass analyzer, in accordance with the principles of the present invention;.

FIG. 5 shows an exemplary embodiment in which that the six-electrode ion trap is used as an ion guide or linear ion trap combining an ESI source to an ion trap mass analyzer. The ESI source consists of sample inlet adapter 200, a nebulizer needle 201, a capillary 203, a skimmer 204 and a short quadrupole ion guider 206. Ions are generated by the nebulizer assisted electrospray in an atmospheric pressure chamber 202, transferred through the capillary 203 to the first differential vacuum stage which is pumped by a vacuum pump 205, and then past the skimmer 204 and a short quadrupole ion guide 206. These ions are then trapped in the six-electrodes ion trap 207, which is located in the second stage of the vacuum chamber 215 pumped by a vacuum pump 209. After the ions are gated out, the process of trapping ions is repeated. Once the ions are cooled down in the six-electrodes ion trap, the ions will be gated out and transferred through another short quadrupole ion guide 208 into the ion trap mass analyzer 210 in the third stage of vacuum chamber pumped by a vacuum pump 214. The ions will be analyzed and detected by a detection system consisted of an ion conversion dynode 211 and an electron multiplier 212. The signal will be processed and displayed in mass spectra. Ions also can be trapped in the short quadrupole 206, which also can be used as a linear ion trap to improve duty-cycle. In this case, the six-electrode ion trap 207 can be used as a fragment device or mass-range selective trapping device.

Figure 6:
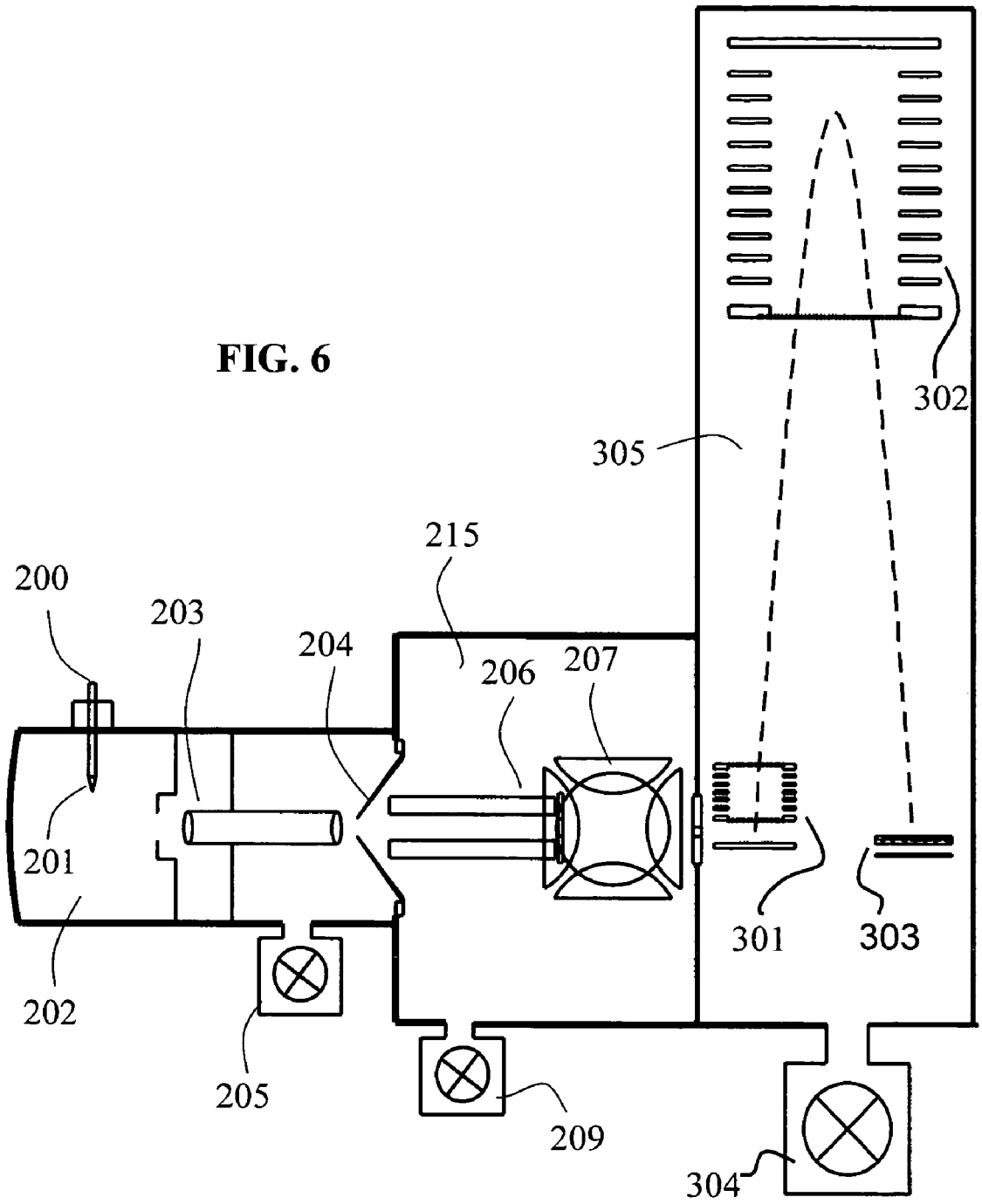
FIG. 6 illustrates a mass spectrometer with six-electrodes ion trap combining ESI source and TOF mass analyzer, in accordance with the principles of the present invention.

FIG. 6 shows another exemplary embodiment in which the six-electrode ion trap is used as an ion guide or linear ion trap to combine an ESI source to a TOF mass analyzer. As described in the previous paragraph, once the ions are cooled down in the six-electrodes ion trap 207, the ions can be gated out and transferred into the TOF mass analyzer in the TOF tuber 305. Ions generated by the ESI source are transferred through six-electrodes ion trap 207 into a TOF tube 305, which is evacuated to low pressures by vacuum pump 304. In TOF tube 305, the ions are pushed in a flight direction by a pusher device 301. The ions are then reflected by a reflectron 302 and detected by a channeltron detector 303. Ions with different mass-to-charge ratios are analyzed according to their different flight times.

Figure 7:
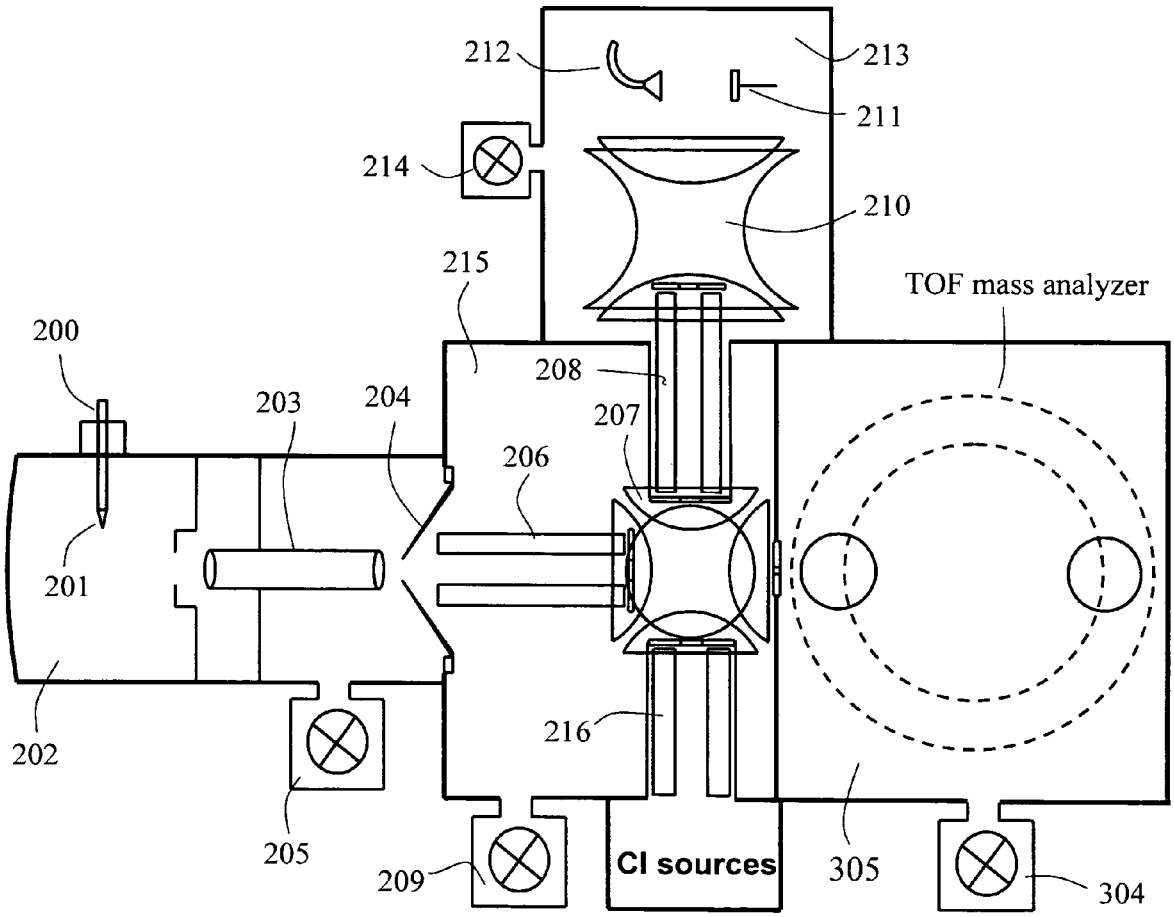
FIG. 7 illustrates a mass spectrometer with two ion sources (i.e. an ESI and CI), and two mass analyzers (i.e. ion trap and TOF) in accordance with the principles of the present invention.

FIG. 7 shows another exemplary embodiment in which a six-electrode ion trap 207 is used as an ion guide or linear ion trap to combine ESI and CI sources 400 with ion trap 210 and TOF mass analyzers 305 (FIG. 6). This combination provides an instrument with many possible operations and functionalities. For example, while ion trap 210 performs the ion fragmentation (MS/MS) or multiplies MS/MS ($MS^n$) function, the daughter ions or granddaughter ions can be transferred back to six-electrodes ion trap 207. The six-electrodes ion trap will redirect and transfer the ions to a TOF mass spectrometer 305, which is coupled in another direction of the six-electrodes ion trap 207. The ions are analyzed by TOF mass spectrometer 305. In another operation, the instrument can perform the electron transfer dissociation (ETD) function by trapping doubly charged positive protein/peptide ions generated by ESI source and negative charged ions generated by CI source 400 in the six-electrodes ion trap 207 and quadrupole ion trap 210. Performing ETD in quadrupole ion trap (QIT) may be easier than doing ETD in a linear ion trap because QIT can simultaneously trap ions of different polarities using three-dimensional RF quadrupole fields.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the invention, and exclusive use of all modifications that come within the scope of the invention is reserved.

The invention claimed is:

1. A multi-electrode ion trap device comprising: six electrodes having curved surfaces arranged in three pairs of opposite located electrodes along three orthogonal axes namely the x, y and z-axis; wherein each of the three pairs of electrodes is configured to act as an ion guides/linear ion trap having a pair of interfaces along the pair axis, wherein the six interfaces are equivalent importing and exporting interfaces, wherein the multi-electrode ion trap device is configured so that any one of the six interfaces is usable to trap external ions and to transfer the trapped ions to any of the other five interfaces.

2. The multi-electrode ion trap device of claim 1 wherein each of the three pairs of electrodes is configured to act as an ion guides/linear ion trap upon application of RF and DC voltages to the pairs of electrodes.

3. The multi-electrode ion trap device of claim 1 wherein multi-electrode ion trap device is configured to trap external ions and to transfer the trapped ions to any one of the other five interfaces upon application of electronic switching voltages to the pairs of electrodes.

4. The multi-electrode ion trap device of the claim 1, wherein the curved surfaces comprise a spherical surface.

5. The multi-electrode ion trap device of the claim 1, wherein the curved surfaces comprise a hyperbolic surface.

6. The multi-electrode ion trap device of claim 1 wherein each interface is connectable to any one of an ionization source and a mass analyzer.

7. The device of the claim 6, wherein the ionization source comprises one of a electron ionization, a chemical ionization, a corona discharge, a fast atom bombardment, a secondary ion mass spectrometry, a plasma desorption, a matrix assisted laser desorption, a field desorption, an electrospray ionization, an atmospheric pressure chemical ionization, an atmospheric pressure photoionization, a plasma and glow discharge, a thermal ionization, and a spark ionization source.

8. The device of the claim 6 wherein the mass analyzer comprises one of a magnetic sector, a quadrupole mass filter, a quadrupole ion trap (QIT), a quadrupole linear ion trap (LTQ), a Fourier transformation ion cyclotron resonance (FT-ICR), a time-of-flight (TOF), a triple quadrupole and their tandem mass analyzer such as Q-TOF, q-QIT, and QIT-TOF.

9. A mass spectrometer comprising: at least an ionization source; at least a mass analyzer; and a multi-electrodes ion trap, wherein the electrodes have curved surfaces, and wherein the multi-electrodes are arranged in three pairs of opposite located electrodes along at least one of three orthogonal axis namely the x, y and z axis, wherein in each of three pairs of electrodes is configured to act as an ion guides/linear ion trap having a pair of interfaces along the pair axis so that the multi-electrodes ion trap has multiple interfaces that are equivalent importing and exporting interfaces, wherein a first one of the multiple interfaces is connected to the ionization source, and another one of the multiple interfaces is connected to the mass analyzer, and wherein the multi-electrode ion trap device is configured so that the first one the interfaces is usable to trap external ions and to transfer the trapped ions to the another one of the multiple interfaces that is connected to the mass analyzer.

10. The mass spectrometer of the claim 9, wherein the ionization source comprises one of a electron ionization, a chemical ionization, a corona discharge, a fast atom bombardment, a secondary ion mass spectrometry, a plasma desorption, a matrix assisted laser desorption, a field desorption, an electrospray ionization, an atmospheric pressure chemical ionization, an atmospheric pressure photo ionization, a plasma and glow discharge, a thermal ionization, and a spark ionization source.

11. The mass spectrometer of the claim 9 wherein the mass analyzer comprises one of a magnetic sector, a quadrupole mass filter, a quadrupole ion trap (QIT), a quadrupole linear ion trap (LTQ), a Fourier transformation ion cyclotron resonance (FT-ICR), a time-of-flight (TOF), a triple quadrupole and their tandem mass analyzer such as Q-TOF, q-QIT, and QIT-TOF.

12. The mass spectrometer of claim 9 wherein the multi electrodes ion trap comprises a six-electrodes ion trap.

* * * * *